United States Patent [19]

Pemper

[11] 4,212,345

[45] Jul. 15, 1980

[54] DEVICE FOR FORMING HOLES IN A FOUNDRY SAND MOLD

[76] Inventor: Steven J. Pemper, 12110 W. Greenfield Ave., West Allis, Wis. 53214

[21] Appl. No.: 16,919

[22] Filed: Mar. 2, 1979

[51] Int. Cl.[2] ..... B22C 13/00; B22C 23/00

[52] U.S. Cl. ..... 164/149; 164/158; 164/162; 188/264 B; 188/322; 277/3; 277/59; 277/74

[58] Field of Search ..... 164/162, 207, 149, 158; 188/322, 264 B; 267/65 R, 34; 277/3, 24, 29, 59, 74, DIG. 1

[56] References Cited

U.S. PATENT DOCUMENTS

| | | | |
|---|---|---|---|
| 1,095,356 | 5/1914 | Riel et al. | 164/162 |
| 1,464,142 | 8/1923 | Smith | 188/264 B |
| 2,155,800 | 4/1939 | Perazo | 164/162 |
| 2,275,806 | 3/1942 | Perazo | 164/162 |
| 2,908,951 | 10/1959 | Melka | 164/162 |

FOREIGN PATENT DOCUMENTS

| | | | |
|---|---|---|---|
| 83224 | 7/1971 | German Democratic Rep. | 164/162 |

*Primary Examiner*—Robert D. Baldwin
*Assistant Examiner*—J. Reed Batten, Jr.
*Attorney, Agent, or Firm*—Andrus, Sceales, Starke & Sawall

[57] ABSTRACT

A device for forming a sprue or vent hole in a foundry sand mold. The device includes a body having a central bore and having an air outlet in the upper end of the body communicating with the bore. An axial opening in the lower end of the body has a smaller diameter than the bore. Mounted for movement within the body is a pin or plunger which has an enlarged head that is slidable within the bore and a lower stem which is slidable within the opening. The pin is urged outwardly of the body by a spring, and a seal is located between the stem portion of the pin and the wall of the body bordering the opening. The pin is formed with an internal passage, one end of which is located at the inner end of the head of the pin and the other end of the passage opens at the side of the stem. As the body is lowered relative to the pin to compress the sand in the flask, the pin will move inwardly of the body against the force of the spring, causing a portion of the air within the bore to exit through the passage and then through the seal to the atmosphere, to thereby dislodge foreign material from the seal. The seal is lubricated by means of a wick which extends into a reservoir of lubricant and terminates along the wall of the bore.

13 Claims, 4 Drawing Figures

DEVICE FOR FORMING HOLES IN A FOUNDRY SAND MOLD

BACKGROUND OF THE INVENTION

When producing sand molds in foundry practice, tools or devices are utilized to automatically form sprues or vent holes in the sand mold. For example, U.S. Pat. No. 2,908,951 shows a device for forming a sprue leading to the mold cavity and an enlarged cup leading to the sprue for facilitating pouring of the molten metal through the cup and sprue to the cavity.

Devices of this type generally include a body or housing which is attached to an upper movable member and a spring loaded pin or plunger is mounted for sliding movement within the body.

In operation, the lower end of the pin is brought into engagement with the pattern and sand is then introduced into the flask. The upper member is lowered into the flask to compress the sand and as the body is lowered the pin will move inwardly of the body against the spring force.

After compressing the sand, the upper member is elevated, withdrawing the tool or device from the sand, leaving a clean sprue or vent hole in the mold.

As the sand is introduced into the flask, the sand particles may lodge in the sliding joint between the body and the pin, with the result that the sprue-making device must be periodically cleaned to remove the accumulation of sand, otherwise excessive wear will occur, requiring replacement of the parts at short intervals. Cleaning of the device requires substantial downtime for the machine.

In order to prevent the entry of sand into the sliding joint, neoprene O-ring seals are generally used at the joint. Over a period of time the neoprene seals tend to dry out, and in some instances cause "freezing" of the pin to the body.

SUMMARY OF THE INVENTION

The invention is directed to an improved device for forming sprues or vent holes in a sand mold. In accordance with the invention, the device includes a tubular body or housing having a central bore and a restricted air outlet in the upper end of the body which communicates with the bore.

Mounted within the body is a pin or plunger having an enlarged upper end or head, which is slidable within the bore, and a lower stem which is slidable within the lower, reduced-diameter end of the bore. The pin is urged outwardly of the bore by a spring, so that the pin will normally be in an extended position.

An O-ring seal is mounted within a groove in the head and seals the joint between the head to the wall of the bore, while a second O-ring seal is located within a groove in the wall bordering the lower end of the bore and seals the joint between the stem of the pin and the body.

The pin is provided with an internal passage which provides communication between the upper end of the bore, above the head of the pin, and the lower end of the bore.

With this construction, downward movement of the body with respect to the pin against the force of the spring causes a portion of the air within the bore to exit through the outlet and a second portion of the air to exit through the internal passage in the pin and then through the second seal to the atmosphere. The air passing through the second seal drives foreign material or sand particles from the sliding joint between the pin and the body. This construction prevents sand from entering the internal working parts of the device and insures a longer life of service and less downtime.

The invention also incorporates a novel lubricating system for lubricating the O-ring seals. The body is provided with one or more longitudinally extending wells or recesses which are spaced outwardly of the bore and are connected to the bore by lateral passages. Each well or recess contains a lubricant and a wick extends from the well into each passage and terminates along the wall of the bore. The lubricant is drawn by capillary action to the wall of the bore and will pass downwardly along the wall to lubricate the seals.

The automatic lubrication system prevents the seals from drying out during service, and thereby prevents possible "freezing" of the moving parts.

Other objects and advantages will appear during the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
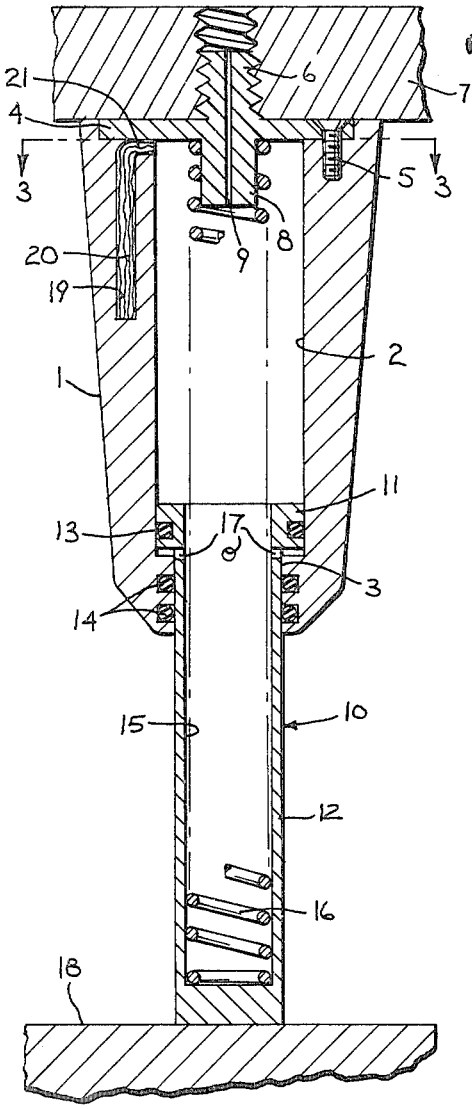
FIG. 1 is a vertical section of the construction of the invention with the pin being in the extended position and in contact with the pattern.

The drawings illustrate an improved tool or device for forming sprues or vent holes in a sand mold. The device includes a tubular body or housing 1 having a central bore 2 and an axial opening 3 in its lower end which has a smaller diameter than the bore 2.

A generally circular cap 4 is secured to the upper end of the body by a series of screws 5, and the cap includes a threaded outer extension 6 which is adapted to be threaded into a vertically moving, support plate 7 to provide a mounting for the device. In practice, the plate 7 may support one or more of the devices of the invention depending upon the size and nature of the sand mold to be made.

Figure 2:
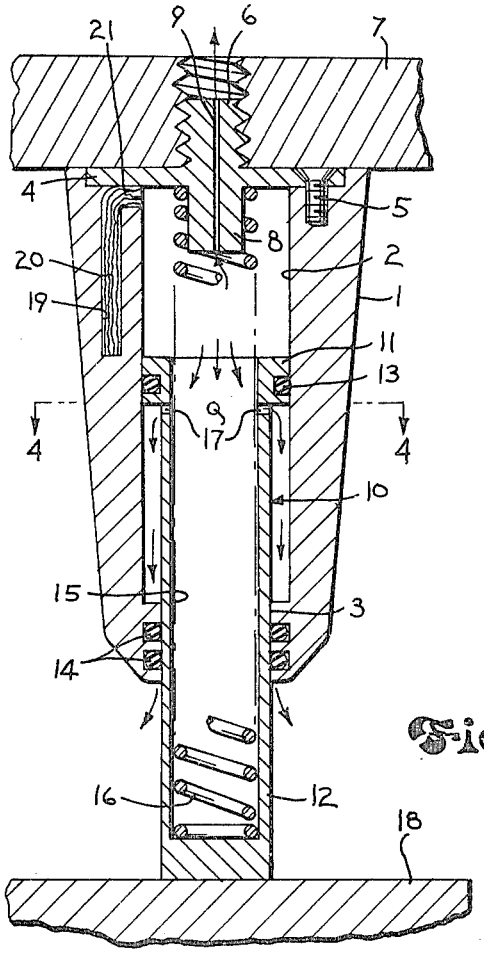
FIG. 2 is a view similar to FIG. 1, showing the pin in a retracted position as the body is lowered to compress the sand in the flask.
Figure 3:
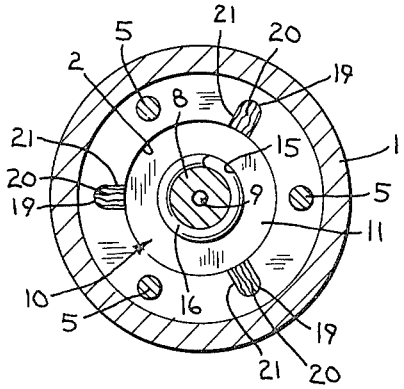
FIG. 3 is a section taken along line 3—3 of FIG. 1.
Figure 4:
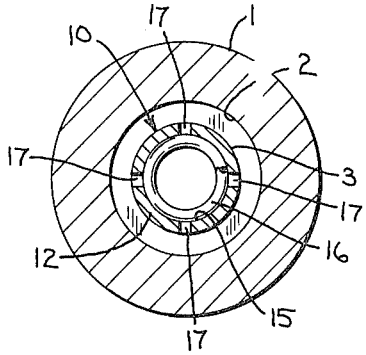
FIG. 4 is a section taken along line 4—4 of FIG. 2.

As shown in FIGS. 1 and 2, the cap 4 is also provided with a central inwardly extending extension 8 and an outlet passage 9 extends through the extension 8 and extension 6 to the atmosphere and provides communication between the bore and the atmosphere.

Mounted for sliding movement within the body 1 is a pin or plunger 10 having an enlarged head 11 and a stem portion 12 of reduced diameter. The head 11 is adapted to ride against the wall of the bore 2 as the pin slides relative to the body and an O-ring seal 13 is mounted within a groove in the periphery of the head and seals the joint or interface between the head and the wall of the bore.

The stem 12 is mounted for sliding movement within the opening 3, and a pair of O-ring seals 14 are mounted within grooves in the wall of the body bordering opening 3 to seal the joint between the body and the stem.

While a pair of O-ring seals 14 are shown, any number of seals can be employed depending upon the size of the device.

The pin 10 has a hollow construction including a central bore 15, and a spring 16 is interposed between the bottom of the bore 15 and the cap 4. The force of the spring 16 urges the pin 10 outwardly to the position shown in FIG. 1. Engagement of the head 11 with the bottom portion of the body provides a stop to limit the outward movement of the pin under the force of the spring.

One or more small ports 17 are formed in the wall of the stem and provide communication between the central bore 15 and the lower portion of the bore 2.

In operation, the plate 7 carrying the device is lowered until the lower end of the pin 10 engages a pattern 18. Sand is then blown into the flask around the device and subsequently the sand is tamped by lowering the plate 7. Lowering of the plate moves the body 1 downwardly relative to the pin 10, and this telescopic movement causes a portion of the air in the upper end of the bore 2 to be discharged through the outlet passage 9, while a second portion of the air within the upper portion of the bore will exit through the bore 15, the ports 17 and around the seals 14 to the exterior, as shown by the arrows in FIG. 2. The outlet passage 9 is restricted in size such that a portion of the air will be discharged through the ports 17 and lower seal 14, and this air passing through the seal will tend to dislodge sand particles and other foreign material from the sliding joint between the stem 12 and body 1.

The invention also includes a novel lubricating system for lubricating the O-ring seals 13 and 14. The lubrication system includes a group of longitudinal wells or recesses 19 which are spaced outwardly of the bore 2 and each well contains a quantity of lubricant, such as oil. A wick 20 made of fabric material is located within each well and extends through a lateral recess 21 formed in the upper end of body 1, with the end of the wick terminating along the wall of the bore 2. The lubricant is drawn by capillary action to the wall of the bore and flows downwardly along the wall to automatically lubricate the seals 13 and 14. The lubrication system prevents drying and cracking of the seals and thereby extends the service life of the unit.

The invention eliminates the problem of the moving parts of the mechanism being clogged with sand, for the relative upward movement of the pin or plunger with respect to the body automatically results in a blast of air being discharged through the lower seal to clean the seal. This cleaning system results in a substantially longer service life for the device and decreases downtime for the machine.

Various modes of carrying out the invention are contemplated as being within the scope of the following claims particularly pointing out and distinctly claiming the subject matter which is regarded as the invention.

I claim:

1. A device for forming holes in a foundry sand mold, comprising a body having a central bore and having an air outlet in the upper end of the body communicating with the bore, a pin mounted for sliding movement within the bore, biasing means for biasing the pin outwardly of the bore, a seal disposed between the lower end of the body and the pin to seal the sliding joint between the body and the pin, and passage means providing communication between the upper end of the bore and the lower end of the bore, upward movement of the pin against the force of the biasing means causing a portion of the air in the upper end of the bore to exit through the outlet and a second portion of the air to exit through said passage means and then through said seal to the atmosphere to thereby drive foreign material from the seal.

2. The device of claim 1, wherein the lower end of said body has an opening axially aligned with the bore and having a smaller diameter than said bore, said pin includes an enlarged head slidable within the bore and a stem slidable within said opening, said seal being connected to the portion of the body bordering said opening.

3. The device of claim 2, wherein said passage means comprises a passage in said pin, one end of said passage terminating in the upper end of the head and the other end of said passage terminating in the side of the stem beneath the head.

4. The device of claim 1, and including lubricating means for supplying a lubricant to the seal.

5. The device of claim 4, wherein said body includes a recess communicating with the bore, a wick disposed within the recess with the outer end of the wick terminating at the wall of the bore, and a quantity of lubricant disposed within the recess, said lubricant flowing by capillary action through the wick to the wall of the bore and then along the bore wall to the seal.

6. The device of claim 5, where said recess includes a first section disposed generally parallel to the bore and a second section extending laterally of the axis of the bore and providing communication between said first section and the bore, said lubricant disposed within said first section and said wick extending within said first and second sections.

7. A device for forming holes in a foundry sand mold comprising a body having a central bore and having an air outlet in the upper end of the body communicating with the bore, said body having an opening in the lower end communicating with the bore and having a smaller diameter than said bore, a pin mounted for sliding movement within the bare and including an upper enlarged head mounted for sliding movement within the bore and having a lower stem portion disposed for sliding movement within the opening, spring means disposed within the bore for urging the pin outwardly of the body, engagement of the head with the lower end of the body bordering the opening acting to limit outward movement of the pin under the force of said spring means, a first seal located between the head and the wall of the bore, and a second seal located between the stem portion of the pin and the wall bordering said opening, said pin having an internal passage, one end of the passage opens at the upper end of the head of the pin and the other end of the passage opens in the side of the stem portion of the pin and spaced below said head, relative movement between the pin and the body against the force of the spring means cuasing a portion of the air within the bore to exit through the outlet and a second portion of the air to exit through said passage and then through said second seal to the atmosphere to thereby drive foreign material from the second seal.

8. The device of claim 7, wherein said second seal comprises an O-ring secured to the wall bordering said opening.

9. The device of claim 7, wherein said other end of the passage is located immediately below the head.

10. A device for forming holes in a foundry sand mold comprising a body having a central bore, a pin mounted for sliding movement within the bore, the outer end of the pin projecting beyond the outer end of the body, a seal located between the wall of the bore and the pin to seal the sliding joint therebetween, said body including a recess communicating with the bore, a wick disposed within the recess with the outer end of the wick terminating at the wall of the bore, and a quantity of lubricant disposed within the recess, said lubricant flowing by capillary action through the wick to the wall of the bore and then along the bore wall to the seal.

11. The device of claim 10, wherein said recess includes a first section disposed generally parallel to the bore and a second section extending laterally of the axis of the bore and providing communication between said first section and the bore, said lubricant disposed within said first section and said wick extending within said first and second sections.

12. The device of claim 11, wherein said first section of the recess is spaced radially outward of the bore and said second section is located in the inner end of the body.

13. A device for forming holes in a foundry sand mold comprising a body having a central bore, a plunger mounted for sliding movement within the bore, the outer end of the plunger projecting beyond the corresponding outer end of the body, a seal disposed between the wall of the bore and the plunger to seal the sliding joint therebetween, biasing means for urging the plunger outwardly of the body, and means responsive to inward movement of the plunger relative to the body against the force of said biasing means for directing air from the inner end of the bore outwardly through said seal to prevent loding of foreign material in said sliding joint.

* * * * *

UNITED STATES PATENT AND TRADEMARK OFFICE

CERTIFICATE OF CORRECTION

PATENT NO. : 4,212,345

DATED : July 15, 1980

INVENTOR(S) : STEVEN J. PEMPER

It is certified that error appears in the above-identified patent and that said Letters Patent are hereby corrected as shown below:

Column 4, Line 41, CLAIM 7 Cancel "bare" and substitute therefor ---bore---, Column 4, Line 57, CLAIM 7, Cancel "cuasing" and substitute therefor ---causing---

Signed and Sealed this

*Twenty-first* Day of *October 1980*

[SEAL]

*Attest:*

SIDNEY A. DIAMOND

*Attesting Officer*

*Commissioner of Patents and Trademarks*